United States Patent [19]

Matsumoto

[11] Patent Number: 5,075,518

[45] Date of Patent: Dec. 24, 1991

[54] JACK WITH SWITCH

[75] Inventor: Kouji Matsumoto, Yao, Japan

[73] Assignee: Hosiden Electronics Co., Ltd., Osaka, Japan

[21] Appl. No.: 501,755

[22] Filed: Mar. 30, 1990

[30] Foreign Application Priority Data

Apr. 7, 1989 [JP] Japan ..... 1-41127[U]

[51] Int. Cl.[5] ..... H01R 33/96

[52] U.S. Cl. ..... 200/51.09; 200/51.10; 439/188

[58] Field of Search ..... 200/51.09, 51.10, 51.11, 200/51.12, 573; 350/96.20; 439/188, 344, 676

[56] References Cited

U.S. PATENT DOCUMENTS

| | | | |
|---|---|---|---|
| 3,949,180 | 4/1976 | Ojima et al. | 200/51.10 |
| 4,426,558 | 1/1984 | Tanaka et al. | 200/51.09 |
| 4,633,048 | 12/1986 | Komatsu | 200/51.10 |
| 4,725,241 | 2/1988 | Bertini et al. | 200/51.10 |
| 4,937,404 | 6/1990 | Kitagawa | 200/51.09 |

FOREIGN PATENT DOCUMENTS

| | | | |
|---|---|---|---|
| 2112589 | 7/1983 | United Kingdom | 439/188 |

*Primary Examiner*—Henry J. Recla
*Assistant Examiner*—Glenn T. Barrett
*Attorney, Agent, or Firm*—Pollock, Vande Sande & Priddy

[57] ABSTRACT

A jack with switch comprises a body that has a plug insertion hole and a switch chamber which is adjacent to the plug insertion hole. The plug insertion hole and the switch chamber communicate with one another. The switch chamber contains a separator partly projecting into the plug insertion hole, a movable contactor piece, and a stationary contactor piece. When a plug is inserted into the plug insertion hole, the separator is transversely displaced to space the movable contactor piece apart from the stationary contactor piece. When the separator is displaced or moved by a predetermined extent, the separator hits a projected wall portion formed in the switch chamber in order to restrict further displacement of the separator. Even if the plug is wrenched in the jack, the movable contactor piece is prevented from excessive displacement.

7 Claims, 3 Drawing Sheets

JACK WITH SWITCH

BACKGROUND OF THE INVENTION

This invention relates to a jack with switch, in which, when a plug is inserted into a plug insertion hole formed in a body of the jack a separator made of insulator material is displaced and the displacing separator displaces a movable contactor piece of the switch in the body.

According to the prior art of this field, when a plug has been wrenched after the plug is inserted into such a jack, a separator in the jack is endlessly displaced and as a result a movable contactor is given excessive displacement, resulting in deformation of the movable contactor and deterioration of contact pressure.

SUMMARY OF THE INVENTION

In consequence, it is the purpose of the present invention to provide a jack with a switch having a movable contactor that is protected from deforming due to a wrenching plug in order to keep a stable contactor pressure for a long term.

According to the present invention, the separator of the jack with switch has a projector extending integrally from the body of the separator perpendicularly to the displacement direction of the separator and a projected wall portion is formed on an inner wall of the body of the jack with switch so as to face the projector. According to the present invention, when the projector is displaced more than a predetermined extent, the projector strikes the projected wall portion and is prohibited from further displacement.

DETAILED EXPLANATION OF PREFERRED EMBODIMENT

Figure 1:
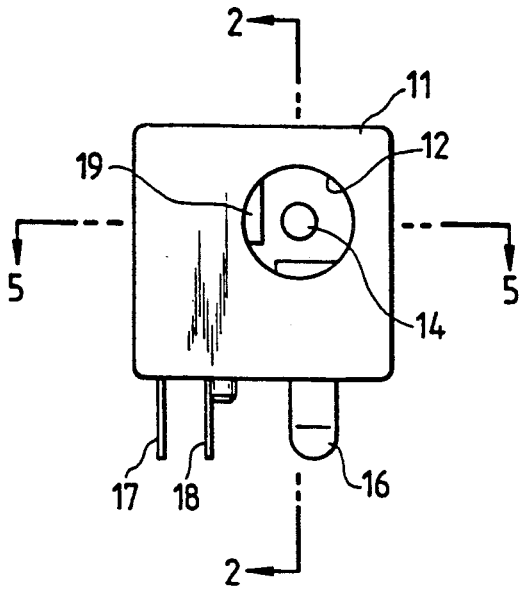
FIG. 1 is a front view of an embodiment of the jack with switch according to the present invention.
Figure 2:
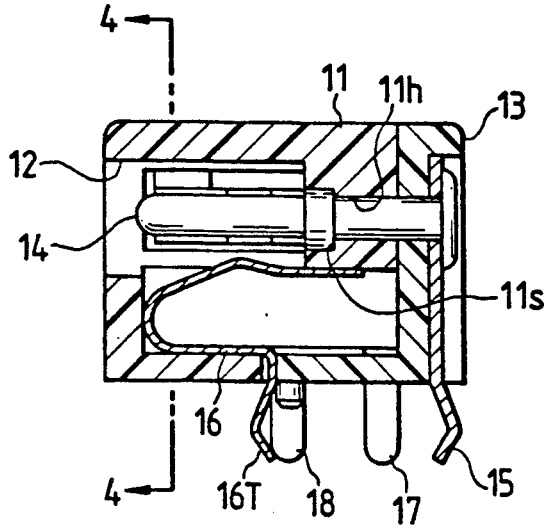
FIG. 2 is a section taken along the line 2—2 in FIG. 1.
Figure 3:
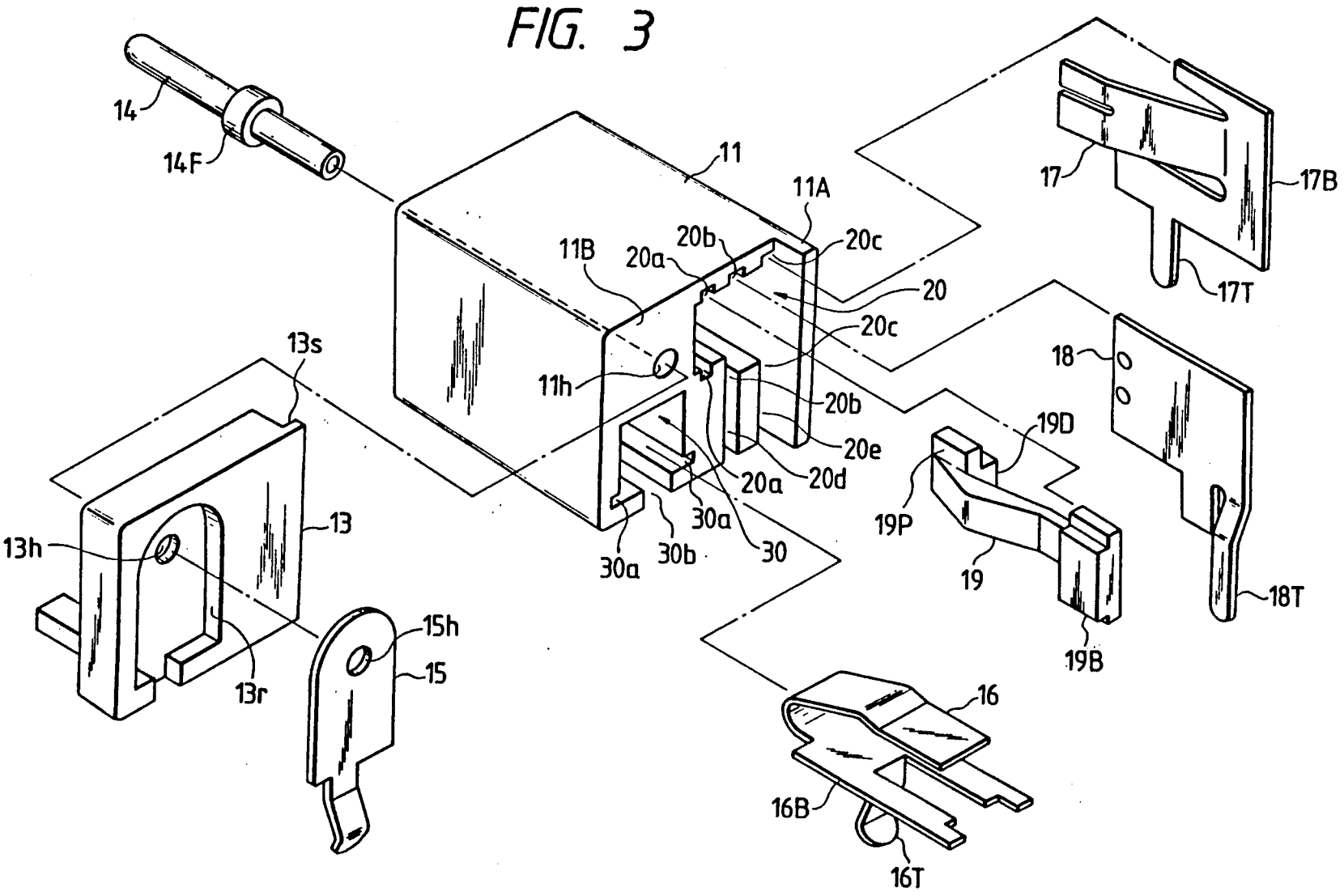
FIG. 3 is a perspective disassembly view seen from rear of the embodiment shown in FIG. 1.

As shown by the front view of FIG. 1 and by the sectional view taken along line 2—2 of FIG. 2, the jack with switch according to the present invention has a body 11 of a substantially square form and a plug insertion hole 12 formed at the front of the body 11. The position of the plug insertion hole 12 is shifted from the front center of the body 11 to one of corners of the front face of the body of the jack with switch. It is apparent from the perspective assembly view of FIG. 3 that the body 11 has a switch chamber 20 and a contact chamber 30, respectively extending from the rear face of the body toward the front of the body 11. The switch chamber 20 and contact chamber 30 are situated at the lateral side and underside of the plug insertion hole 12, respectively, and communicate with the plug insertion hole 12. As shown in FIG. 3, a through hole 11*h* is formed, in the rear wall 11B of the body 11 of the jack with switch in alignment with the center line of the plug insertion hole 12. Through the hole 11*h*, a contact pin 14 is inserted from the front face of the body 11. A flange 14F of the contact pin 14 is engaged with an angular stepped portion 11*s* formed at the front peripheral edge of the through hole 11*h*.

When a contactor piece 16 which is substantially U-shaped as shown in FIG. 3 is inserted into the contact chamber 30 from the rear face of the body 11, both side edges of the base portion 16B of the contactor piece 16 are inserted and guided through the guide grooves 30*a* formed at both sides of a floor of the contact chamber 30. A free end of the contactor piece 16 partly projects into the plug insertion hole 12 and a contact terminal 16T of the contactor piece 16 projects out of the body 11 through the slot 30*b* formed in the floor of the contact chamber 30. A separator 19 made of an insulation material shiftable transversely is inserted into the switch chamber 20 from the rear of the body 11 and, as a result, a base 19B of the separator 19 is inserted and secured to guide grooves 20*a* formed in the ceiling and floor of the chamber 20. A part of the separator 19 projects into the plug insertion hole 12 through a slot 41 bored through an inner wall portion 42 between the plug insertion hole 12 and the switch chamber 20. A stationary contactor piece 18 and a movable contactor piece 17 are inserted into the switch chamber 20 with their upper and lower side edges guided in guide grooves 20*b*, 20*c* formed in the floor and the ceiling of the chamber 20, and are disposed in a spaced and parallel relation to each other on one side of the separator 19 opposite from the plug insertion hole 12, thus forming a switch of the jack.

The contact terminals 18T and 17T of the stationary and the movable contactor pieces 18 and 17 are projected out of the body 11 through the slots 20*d* and 20*e* formed in the floor of the switch chamber 20. The lengths of the guide grooves 20*a*, the slots 20*d* and 30*b* are selected so that the rear ends of the separator 19, the stationary contactor piece 18 and the U-shaped contactor piece 16 are substantially flush with the rear end face of the body 11 and are secured at their positions. In a state where separator 19, the stationary contact piece 18, and the movable contact piece 17 are assembled in the switch chamber 20, the free end of the movable contact piece 17 resiliently contacts the stationary contactor piece 18. A drive portion 19D of the separator 19 and a free end of the movable contactor piece 17 are adjacent and opposed to each other beyond the front end of the stationary contactor piece 18. When the separator 19 is shifted transversely, the drive portion 19D of the separator 19 shifts transversely the free end of the movable contactor piece 17 so as to space the free end apart from the stationary contactor piece 18.

Figure 4:
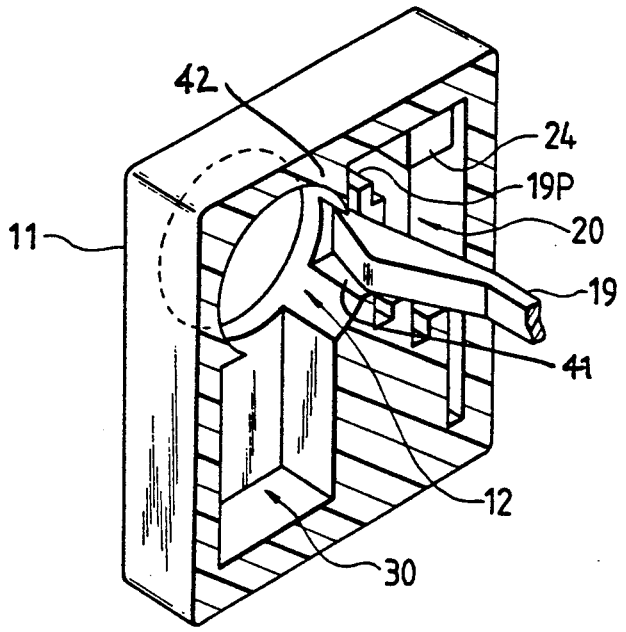
FIG. 4 is a perspective view sectioned along the line 4—4 of FIG. 2, depicting the body of the jack with switch and a part of the separator.
Figure 5:
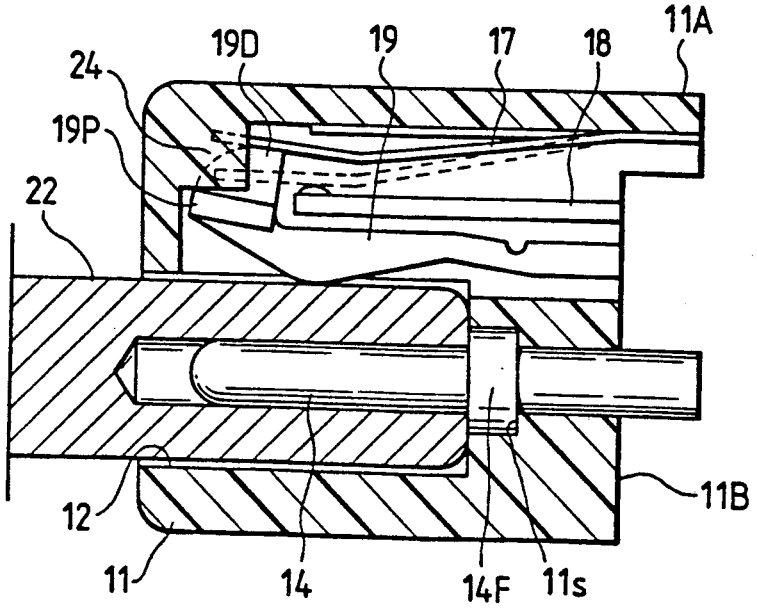
FIG. 5 is a section taken along line 5—5 of FIG. 1, showing partly the plug insertion condition.

A rear lid 13 has a stepped portion 13*s* projecting from one side of the body 11, which stepped portion 13*s* engages with a rearward projection 11A projected rearwardly from one side wall of the body 11. After the U-shaped contactor piece 16, the movable contactor piece 17, the stationary contactor piece 18, and the separator 19 are installed in the interior of the body 11, the rear lid 13 is applied to the rear end face of the body 11 so that the rear end of contact pin 14 projecting out from the through hole 11*h* is inserted into a through hole 13*h* of the rear lid 13. The rear end of the contact pin 14 is inserted through a hole 15*h* formed in a lug plate 15 and then the lug plate 15 is fitted into a concave portion 13*r* formed on the rear face of the rear lid 13. Then, the rear end of the cylindrical contact pin 14 is expanded by a press as shown in FIG. 2 so as to secure the rear lid 13 to the body 11 by means of a caulking. The contact pin 14 and the lug plate 15 are thus electrically connected. The separator 19 has a thin portion rear its base 19B as shown in FIG. 3, so the separator 19 can shifts transversely and resiliently. The drive portion 19D of the separator 19 has an upward projector 19P as shown in FIG. 3. When the separator 19 is fitted into the body 11 of the jack with switch, the projector 19P is placed between a projected wall portion 24 formed integrally on the inner wall face of the switch chamber 20 and the inner wall portion 42 defining the side wall of the plug insertion hole 12 as shown in FIGS. 4 and 5. FIG. 4 shows only part of the body 11 and the separator 19.

It is apparent from FIG. 5 that when a plug 22 is inserted through the plug insertion hole 12, the pin 14 is inserted into a shaft hole of the plug 22 and the U-shaped contactor piece 16 is resiliently urged to the side face of the plug 22. Further insertion of the plug 22 displaces transversely the separator 19 and the separator is driven out of the plug insertion hole 12 by the insertion of the plug 22. Further it is apparent from FIG. 5 that, as a result of the operation above, the movable contactor piece 17 is pushed downwardly in FIG. 5 by the drive portion 19D of the separator 19, and finally the movable contactor piece 17 is separated from the stationary contactor piece 18 as shown by the solid line.

According to the present invention, on the interior wall of the switch chamber 20, the projected wall portion 24 is formed so as to face the projector 19P formed on the separator 19 to extend in direction perpendicular to the displacement direction of the separator 19 (upward direction, in FIG. 4). When the projector 19P is displaced away from the central axis of plug insertion hole 12 more than a predetermined degree, the projector 19P abuts against the projected wall portion 24, whereby further displacement of the projector 19P is limited. Similarly, excessive displacement of the separator 19 toward the central axis of the plug insertion hole 12 is limited by abutment between projector 19P and the inner wall portion 42.

When the plug 22 is accidentally wrenched after it is inserted to the plug insertion hole and the separator 19 is displaced more than the predetermined degree, the projector 19P hits the projected wall portion 24, restricting further displacement of the separator 19 and consequently preventing the movable contactor piece 17 from being applied with excessive displacement.

As described above, according to the present invention, by providing a projector on the separator and a projected wall portion for restricting excessive displacement on the body of the jack with switch, when the plug is wrenched after its insertion or application to the jack, the separator is not excessively displaced and also the movable contactor piece is not displaced too much, resulting in no deformation of the movable contactor, keeping sufficient contact pressure between the stationary contactor piece and the movable contactor piece.

What is claimed is:

1. A jack with a switch comprising:

a substantially square body of insulating material having a plug insertion hole formed therein to extend rearward from a front face of said body, a switch chamber formed in said body adjacent to said plug insertion hole, said switch chamber communicating with said plug insertion hole through a slot formed in an inner wall portion of said body between said plug insertion hole and said switch chamber;

a separator arranged in said switch chamber, said separator having a portion projecting into said plug insertion hole through said slot so that said separator is displaceable transversely by insertion of a plug into said plug insertion hole, said separator having a projector which projects in a direction perpendicular to a plane in which said separator displaces;

switch means disposed in said switch chamber and driven to ON-OFF by displacement of said separator means;

first displacement restriction means formed integrally with said body on an inner wall surface of said switch chamber and positioned to be hit by said projector when said separator is displaced away from the center axis of said plug insertion hole by a predetermined extent, whereby said separator is prevented from being displaced more than said predetermined extent; and second displacement restriction means formed as part of said inner wall portion of said body and positioned so as to be hit by said projector when said separator is displaced toward said center axis of said plug insertion hole, whereby said separator is prevented from being displaced excessively into said plug insertion hole.

2. The jack with switch set forth in claim 1, wherein said separator has a base integrally formed with a rear end of said separator and adapted to be secured to said body, said separator being made of an insulator material, a portion adjacent to the base of said separator being made thin to provide resilient deformability of said separator.

3. The jack with switch set forth in claim 1, wherein said body has a contact chamber formed therein adjacent said plug insertion hole and communicating with at least a part of the plug insertion hole, said contact chamber containing a resilient movable contactor piece provided with at least a part that projects into said plug insertion hole.

4. The jack with switch set forth in claim 3, wherein said switch chamber and said contact chamber have an angular relationship to each other with respect to the plug insertion hole.

5. The jack with switch according to claims 1 or 2, wherein said switch chamber is formed to extend forward from a rear face of said body.

6. The jack with switch according to claim 1, wherein said switch means comprises a movable contactor piece having a resiliently displaceable free end arranged so as to oppose said separator with a gap therebetween, and a stationary contactor piece arranged between the separator and said movable contactor piece so as to resiliently press the free end of said stationary contactor piece, and said separator having a drive portion which comes near and faces said free end of said movable contactor piece beyond the front end of said stationary contact piece in order to space said free end apart from said stationary contactor piece when said separator is transversely displaced.

7. The jack with switch according to claim 6, wherein a rear face of said body is covered by a lid in order to close said switch chamber.

* * * * *